US005125260A

United States Patent [19]

Hedeen

[11] Patent Number: 5,125,260

[45] Date of Patent: Jun. 30, 1992

[54] CALIBRATOR AND CALIBRATION METHOD FOR COMPUTATIONALLY COMPENSATING FOR PHASE MISMATCH IN SOUND INTENSITY PROBES

[75] Inventor: Robert A. Hedeen, Clifton Park, N.Y.

[73] Assignee: General Electric Company, Schenectady, N.Y.

[21] Appl. No.: 612,936

[22] Filed: Nov. 14, 1990

[51] Int. Cl.[5] ..... H04R 29/00

[52] U.S. Cl. ..... 73/10 V; 73/659; 367/13; 364/571.04

[58] Field of Search ..... 73/10 V, 659; 364/571.02, 571.04; 367/13

[56] References Cited

U.S. PATENT DOCUMENTS

| | | | |
|---|---|---|---|
| 2,558,550 | 6/1951 | Fiske, Jr. | 73/10 V |
| 3,098,211 | 7/1963 | Gerber | 73/10 V |
| 4,205,394 | 5/1980 | Pickens | 367/13 |
| 4,375,679 | 3/1983 | Park, Jr. et al. | 367/13 |
| 4,473,797 | 9/1984 | Shiota | 364/571.04 |
| 4,715,219 | 12/1987 | Frederiksen | 73/10 V |

*Primary Examiner*—Hezron E. Williams
*Assistant Examiner*—Rose M. Finley
*Attorney, Agent, or Firm*—Patrick R. Scanlon; James C. Davis, Jr.; Paul R. Webb, II

[57] ABSTRACT

A calibrator and the derivation of an associated calibration data base for computationally compensating for gain and phase mismatch in sound intensity probes comprised of two unmatched pressure transducing microphones is described herein. The calibrator utilizes a unique 'phase plug' to maintain temporal uniformity (in addition to standard spatial uniformity) in the sound field of the calibration chamber. Gain and phase calibration factors are independently obtained for each probe of interest using the calibrator and these data are compiled into an independent data base for storage and subsequent application. Such linear correction factors as applied to associated signal processing of probe measurements serves to computationally compensate for phase mismatch between the unmatched microphone pair.

11 Claims, 1 Drawing Sheet

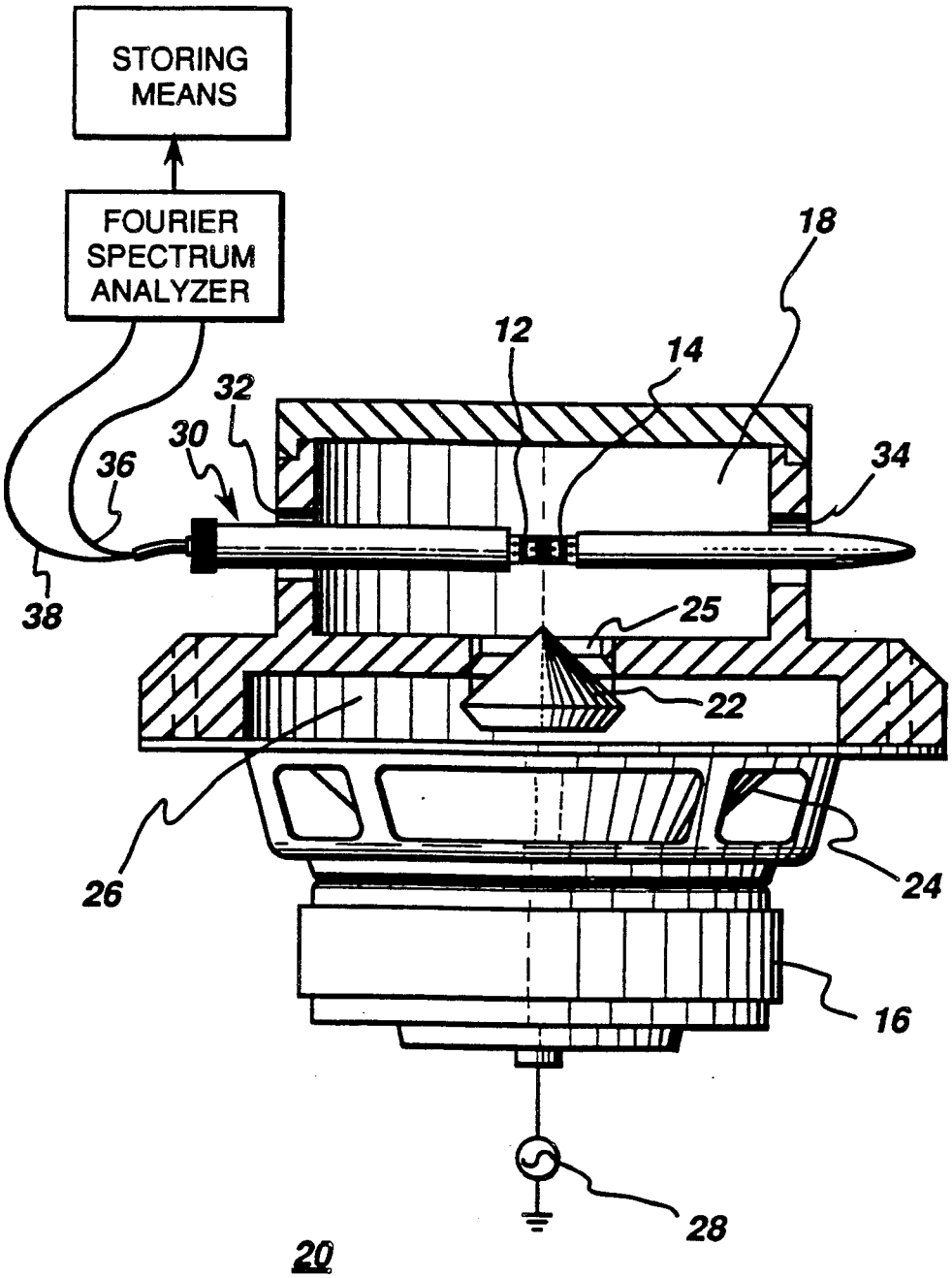
STORING MEANS
FOURIER SPECTRUM ANALYZER
18
12
14
32
30
36
34
38
25
22
26
24
16
28
20

CALIBRATOR AND CALIBRATION METHOD FOR COMPUTATIONALLY COMPENSATING FOR PHASE MISMATCH IN SOUND INTENSITY PROBES

RELATED APPLICATIONS

This application is related to copending patent application Ser. No. 07/612,937 filed concurrently herewith and assigned to the same assignee as the present application.

BACKGROUND OF THE INVENTION

The present invention is directed to a new and improved method and associated device for calibrating sound intensity probes. A plurality of sound intensity probes when so calibrated can be adapted for use as discrete measurement points comprising a portable probe array designed to accomplish rapid in situ sound testing of a test object in an environment of ambient background noise.

Calibration is imperative to the usefulness of a mutually spaced pair of condenser type microphones adapted for use as a sound intensity probe. Calibration is even more critical as there are no present standards for sound intensity measurements. Particularly lacking are standards for in situ measurements. Conventional sound intensity probes are typically phase matched by the manufacturer—a careful and delicate physically altering process which escalates the cost of these commercially available probes into the $5000 to $10,000 range.

The technique of calculating sound power flow from a sound source using spectral analysis is recognized as an in situ method for measuring sound emission of products in a production line setting. In situ sound testing involves taking measurements on a test object where it lies—amidst ambient background noise. For in situ sound power testing applications, the background environment is not merely undesirable signal distortion to be disregarded, but part of the measurable signal, to be retained and eventually averaged away through calculation of the total emitted sound power. The technique requires that time histories for each microphone pair of a plurality of sound intensity probes be made over the same time interval and collected over a sufficiently distributed array of such probes.

Heretofore, such a measurement collection scheme was in practice prohibited by the excessive cost of securing a plurality of commercially available phase matched sound intensity probes. The calibrator and calibration method disclosed herein offer a way of calibrating common, inexpensive, unmatched microphone pairs for utilization as pressure transducing sound intensity probes. Each probe's gain and phase calibration factors are independently obtained and stored as part of an external data base for subsequent utilization. Calibration correction can be linearly applied in the direct signal processing required to determine sound intensity at each probe. The calibration data base as obtained for a plurality of probes which have been adapted for use in an arbitrary test measurement array, is used to computationally compensate for phase distortion in time histories simultaneously collected from each probe microphone. The use of independent calibration factors permits simultaneous correlation of the entire plurality of array probes in a practical manner. Furthermore, the technique produces results comparable to those heretofore only obtainable from expensive, high quality, commercially available sound intensity probes. The reader is referred to the above mentioned application Ser. No. 07/612,937 for further discussion of this compensation technique as applied to in situ sound testing.

Generally, there are two separable components contributing to phase distortion between electrical signals transduced from the displacement of respective diaphragms of a condenser microphone pair comprising a typical sound intensity probe. One is a sound field component due to the passage of acoustic energy waves through the sound field itself. The other is distortion due to physical transduction of the signal. Transduction distortion introduced by physical differences between the microphones of the probe itself are constant and time invariant. Furthermore, this type of phase distortion is independent and separable from sound field distortion. The invariance coupled with separability allows a calibration correction to be implemented. Calibration is distinguished from performance monitoring; in that only invariant, linearly separable errors can be calibrated. Once determined, calibration correction factors can be independently stored for subsequent application during signal processing.

The calibrator disclosed herein controls the sound field component of phase distortion so that the physical transduction component can be more accurately quantified by a calibration factor independent of any other systematic distortion. This independent calibration technique provides a simple linear computational means to compensate for phase mismatch between microphone pairs in any number of probes.

It is therefore an object of the present invention to better control temporal sound field distortion through improved calibrator design in order to more accurately quantify calibration of phase mismatch due to physical differences between the pair of microphones comprising the probe.

It is another object of the invention that the calibrator and calibration technique be rugged, portable, easy to use and rapid to accommodate frequent on site calibration checks of probes.

It is further an object of the invention that the calibration technique be adapted to simultaneously calibrate any number of discrete measurement points comprised of a plurality of probes for in situ testing using independently derived calibrator correction factors.

It is yet another further object of the invention that the calibration scheme accommodate the on site need to change or replace probe microphone(s) in the field with the capability of rapid and reliable recalibration. Such capability allows the response character of the probe to be altered by replacing either or both microphones and/or the associated mutual spacer.

SUMMARY OF THE INVENTION

The present invention is directed to a new and improved method and device for calibrating and compensating for phase distortion in pressure transducing sound intensity probes.

The phase difference due to invariant physical differences between the condenser microphones of a probe pair can be calibrated using a small, portable, rapid, reliable calibrator specially adapted to calibrating a plurality of probes comprising a probe array for in situ sound testing. The calibrator is comprised of a common externally driven broad band loudspeaker, an enclosed calibration chamber and a specially designed phase plug. The phase plug is uniquely designed and situated to selectively time regulate entry of only coherent sound pressure wavefronts into the calibration chamber. The shape and dimensions of the calibration chamber control spatial uniformity of the enclosed sound field; while the phase plug controls temporal uniformity of the enclosed sound field. A probe is inserted through either of a pair of oppositely disposed monitoring holes situated on either side of the calibration chamber. Once disposed within the enclosed calibration chamber, the microphone pair is exposed to a nominally identical sound field and calibration proceeds as follows:

Gain for each microphone is determined against an independently calibrated standard reference microphone by exposing both standard probe and test probe to a wide range of applied frequencies. For each desired frequency the microphone's channel sensitivity is adjusted to that of the known standard microphone using a multi-channel Fourier spectrum analyzer. Phase difference between the microphone pair is subsequently determined directly on the Fourier spectrum analyzer from a direct determination of the complex transfer function that describes signal transformation between the gain calibrated channels of each microphone. A gain for each microphone and an associated phase difference between each pair are recorded for each probe of interest and compiled into an independent data base. The data base is suitably stored so that the calibration correction factors can be subsequently applied to linearly correct each probe's sound intensity calculation and thereby compensate for phase mismatch introduced by using common, inexpensive, unmatched microphones as pressure transducers in sound intensity probes.

BRIEF DESCRIPTION OF THE DRAWING

FIG. 1 is a side elevational view partially in section of the phase calibrator.

DETAILED DESCRIPTION OF THE INVENTION

The present invention is directed to a new and improved calibrator and calibration method for computationally compensating for phase mismatch in sound intensity probes.

FIG. 1 discloses such a probe which typically comprises at least two inexpensive off-the-shelf condenser microphones, 12 and 14, mutually spaced a known distance apart and adapted to measure sound intensity; without the benefit of phase matching during manufacture.

The calibrator 20 is designed to control and minimize distortion in the sound field presented to the diaphragm of each microphone, 12, 14; thus, any phase difference measured between the two microphone signals is attributable to differences in the physical configuration of the microphones themselves. This invariant phase difference can be corrected by an appropriate calibration factor. The calibrator 20 is small, portable and capable of rapid, repeated, and accurate on site calibration of any microphone pair selected to constitute a sound intensity probe. The calibrator 20 is comprised of a common loudspeaker element, 16, an enclosed calibration or pressure chamber 18 and a specially designed phase plug 22. The diaphragm 24 of the loudspeaker element 16 faces an enclosed chamber 26 connected by a communicating passage 25 to the calibration chamber 18. The phase plug 22 shields the orifice on the loudspeaker side of communicating passage 25. The phase plug 22 is so designed to selectively regulate the entry of sound pressure wavefronts generated by loudspeaker 16 for introduction into pressure chamber 18.

The loudspeaker 16 is driven by an external oscillator 28 and presents a uniform broad band pressure field of preselected frequency range to the phase plug 22 which shields the acoustic entrance to the calibration chamber 18. The phase plug 22 is rigid (acoustically nonabsorbing) and geometrically designed to cooperate with the wavelength of sound emanating from diaphragm 24 of the loudspeaker in such a way as to only allow sound waves to pass through communicating passage 25 into calibration chamber 18 in phase with one another. In this way, sound waves enter calibration chamber 18 in time aligned fashion, assuring temporal uniformity of the sound field for calibration measurements. Once inside the pressure chamber 18, spatial uniformity of the sound field is assured by the shape and dimensions of the chamber itself. The shape of the calibration chamber is symmetrical with respect to the propagation of entering sound waves. The size of the pressure chamber is much less than the wavelength of sound at the highest frequency of interest; this minimizes the possibility of reflections within the pressure chamber, and eliminates standing waves to create a uniform sound field for calibration measurements. These constraints on the calibrator ensure that a spatially and temporally uniform sound field is presented to the microphone pair 12, 14 constituting the sound intensity probe 30 as disposed within calibration chamber 18.

The operation of the calibrator is initiated by first inserting a probe 30 into calibration chamber 18, through either of a pair of monitoring holes 32, or 34, disposed opposite one another on either side of the pressure chamber 18 so that both microphones 12, 14 of probe 30 are exposed to identical sound fields. Under such conditions the gain and phase difference between the microphone pair are calculated as follows:

Probe 30 and a standard reference microphone independently calibrated via some other means are inserted together into the calibration chamber 18 and positioned near its center. Note another monitoring hole (not shown) accommodates the standard reference microphone (also not shown). Electrical output signals 36 and 38 are transduced from each probe microphone 12 and 14 respectively in response to band limited random sound applied by the loudspeaker system 16, 24, 28 to the calibration chamber 18. Each output signal is input on a separate channel to a multi-channel Fourier spectrum analyzer. The Fourier spectrum analyzer is used to adjust the channel sensitivities of each microphone of the probe pair to match that of the known reference microphone over a wide range of applied frequencies. Phase mismatch due to associated data channel instrumentation (e.g. cables, connectors, etc.) is eliminated by physically switching, i.e. interchanging, the respective microphone data channel leads, then recalibrating and averaging the result. Any positional variations in the pressure chamber can also be averaged away by recalibrating after the sensing positions of the microphones have been interchanged. This is accomplished by inserting the probe into the calibration chamber in the opposite direction through the opposing mounting hole, e.g. 34 as opposed to 32, or vice versa. Average measurements for each probe provide an absolute measure of gain sensitivity relative to the reference microphone.

The Fourier spectrum analyzer is also used to directly measure the complex transfer function between gain calibrated channels of the probe microphone pair. Assuming microphone 12 signal output to be an "input" to this transfer function and microphone 14 signal output to be a corresponding "output", the associated complex transfer function between the two microphones can be evaluated. If the gain calibration was done correctly, then the magnitude of the transfer function associated with each microphone 12, 14, is unity and the argument of this microphone to microphone complex transfer function adequately approximates the phase angle describing signal delay between the two microphones.

Values of gain for each microphone, $g_A$ and $g_B$ along with the phase difference detected between them, $\Theta_i$, are recorded for compilation in a data base and stored on a suitable storage means e.g. magnetic tape or computer disk. The data base is independently applied to linearly correct each probe's cross spectrum in a direct Fourier signal processing determination of sound intensity at that probe. This calibration technique allows a plurality of probes to be calibrated and the stored calibration factors subsequently applied to computationally compensate for phase mismatch between each probe's microphone pair Thus, any probe pair can serve as a sound intensity probe as long as the calibration factor is available in the data base for phase compensating measurements taken therefrom.

It will be appreciated that other embodiments are possible with the spirit and scope of the present invention.

What is claimed is:

1. An apparatus for calibrating at least two unmatched mutually spaced pressure transducing microphones adapted for use as a sound intensity probe comprising:

a calibration chamber where calibration measurements are made on a probe disposed therein;

a sound chamber acoustically coupled to said calibration chamber by a communication passage;

a loudspeaker disposed in said sound chamber;

means for selectively permitting only time aligned sound pressure wavefronts to enter said calibration chamber through said communication passage; and a storing means for storing said calibration measurements for independent application to correct subsequent signal processing and thereby computationally compensate for phase mismatch between said microphones.

2. Apparatus in accordance with claim 1 wherein said loudspeaker is a loudspeaker which produces a broad band of applied acoustic frequencies.

3. Apparatus in accordance with claim 1 wherein said calibration chamber is sized and shaped to minimize spatial disruption and thereby spatially control a sound field therein.

4. Apparatus in accordance with claim 1 further comprising a pair of oppositely facing monitoring holes disposed on either side of said calibration chamber through which a probe to be tested can be inserted.

5. A method for calibrating at least two unmatched mutually spaced pressure transducing microphones adapted for use as a sound intensity probe comprising the steps of:

inserting said probe into a calibration chamber;

selectively permitting only time aligned sound pressure wavefronts to enter said calibration chamber;

measuring gain for each electrical output signal transduced from each of said microphones;

measuring phase difference between each electrical output signal transduced from each of said microphones; and storing said gain and phase measurements for independent application to compensate for phase mismatch between said microphones by linearly correcting spectral signal processing as applied to said probe.

6. Method in accordance with claim 5 wherein the step of measuring gain is performed on a Fourier spectrum analyzer.

7. Method in accordance with claim 5 wherein the step of measuring gain is performed relative to an independently calibrated standard reference probe.

8. Method in accordance with claim 5 wherein the step of measuring phase difference is performed on a Fourier spectrum analyzer.

9. Method in accordance with claim 8 wherein the step of measuring phase difference is performed subsequent to the step of measuring gain.

10. Method in accordance with claim 5 wherein channel leads to each respective probe microphone are interchanged and recalibration measurement is effected in order that extraneous instrumentation phase mismatch be eliminated through an averaging of both calibration measurements.

11. Method in accordance with claim 5 wherein microphone sensing positions are interchanged and recalibration measurement is effected in order that any extraneous spatial sound field distortion be minimized through an averaging of both calibration measurements.

* * * * *